US011457777B1

(12) United States Patent
Lekic

(10) Patent No.: US 11,457,777 B1
(45) Date of Patent: Oct. 4, 2022

(54) TOILET TOOL HANDLE WITH RETRACTABLE COVER

(71) Applicant: Adnan Lekic, New York, NY (US)

(72) Inventor: Adnan Lekic, New York, NY (US)

(73) Assignee: Adnan Lekic, New York, NY (US)

( * ) Notice: Subject to any disclaimer, the term of this patent is extended or adjusted under 35 U.S.C. 154(b) by 383 days.

(21) Appl. No.: 16/874,110

(22) Filed: May 14, 2020

(51) Int. Cl.

| | |
|---|---|
| ***A47K 11/10*** | (2006.01) |
| ***A46B 15/00*** | (2006.01) |
| ***A46B 5/00*** | (2006.01) |
| ***E03C 1/304*** | (2006.01) |
| ***B25G 1/10*** | (2006.01) |
| ***A46B 9/02*** | (2006.01) |
| *B25G 3/30* | (2006.01) |

(52) U.S. Cl.
CPC ..... *A47K 11/10* (2013.01); *A46B 5/00* (2013.01); *A46B 9/026* (2013.01); *A46B 15/0095* (2013.01); *B25G 1/10* (2013.01); *E03C 1/304* (2013.01); *A46B 2200/304* (2013.01); *B25G 3/30* (2013.01)

(58) Field of Classification Search
CPC ..... F16M 11/2021; F16M 11/2092; F16M 11/22; F16M 11/28; A47K 11/10; A46B 9/028; A46B 15/0095; A46B 15/0097; A46B 17/02; A46B 17/04; A46B 2200/304
USPC ..... 248/110
See application file for complete search history.

(56) References Cited

U.S. PATENT DOCUMENTS

| | | | |
|---|---|---|---|
| 543,028 | A | 7/1895 | Laws |
| 1,960,807 | A | 5/1934 | Cole |
| 2,651,070 | A | 9/1953 | Zimmerman |
| 6,622,316 | B1 | 9/2003 | Brown |
| 6,813,785 | B1 | 11/2004 | Baker |
| 8,707,504 | B2 | 4/2014 | Ryan |
| 9,622,629 | B1 | 4/2017 | Brittain |
| 2020/0015583 | A1 | 1/2020 | Mart et al. |

FOREIGN PATENT DOCUMENTS

DE 19907879 A1 * 8/2000 ..... A46B 15/00

* cited by examiner

*Primary Examiner* — Michael D Jennings
*Assistant Examiner* — Aaron R McConnell

(57) ABSTRACT

A toilet tool handle with retractable tool head cover is disclosed. An elongate tool handle has an end with a tool head connector thereon. A rack gear extending along the handle's longitudinal axis is positioned adjacent the end. An actuator sleeve, slidable along the handle, has a bearing mounted on it which holds a pinion gear engaged with the rack gear. The tool head cover is connected to the pinion gear such that sliding action of the actuator sleeve with respect to the handle slides the pinion gear with respect to the rack gear. Engagement of the pinion gear teeth with the rack gear teeth causes the pinion gear to rotate and causes the tool head cover to rotate from a first position where it encloses the handle end to a second position where it is rotatably retracted away from the handle end.

6 Claims, 7 Drawing Sheets

TOILET TOOL HANDLE WITH RETRACTABLE COVER

BACKGROUND OF THE INVENTION

This invention generally relates to hand tools, and more particularly to handles of hand tools.

Cleaning and unclogging the toilet is generally an unpleasant task which few enjoy. One aspect associated with the task is being mindful not to drip contaminated toilet bowl water on surfaces outside the toilet bowl when using a toilet hand tool such as a toilet bowl brush or toilet plunger. This is problematic because the hand tool's head has typically come into contact with or been immersed in the toilet bowl water while being used.

One way to prevent contaminated toilet bowl water from dripping onto surfaces outside the toilet bowl when removing it from the bowl after use is to provide a guard or cover which can enclose the tool head after use to prevent toilet bowl water drippage from the tool head. There are toilet hand tools in the prior art which have attempted to address the problem to some extent, but are lacking in one way or another. For example, U.S. Pat. No. 6,622,316 issued to Brown discloses a dripless plunger which uses a spring actuated, multi-sectioned cover to enclose the plunger head. Brown's design is complex, however. It requires many expensive to produce moving parts which are problematic to put into practice. Another toilet plunger guard or cover which addresses the drippage problem but falls short is disclosed in U.S. Pat. No. 6,813,785 issued to Baker. Baker's plunger container lacks a cover retracting mechanism, relying instead on the user of the device to manipulate it open by raking it across the toilet seat in order to separate the two plunger container halves. This design is rather undesirable in that the two container halves do not cover the plunger cup in any appreciable way until the user raises the plunger above the toilet bowl and also the container halves come into contact with the toilet seat after the internal walls of the container have been previously contaminated with toilet bowl water drippage from a prior use.

There are other toilet hand tools in the prior art with tool head covers not designed to address the issue of toilet bowl water drippage. U.S. Pat. No. 9,622,629 issued to Brittain discloses a toilet bowl brush with a retractable enclosure which surrounds the sides of the brush head but does not enclose the end of the brush head itself. Brittain's enclosure is fitted with ultraviolet lights dispersed radially around the brush head which are used to kill microorganisms collected on the brush head while cleaning the toilet. The lack of an enclosure wall covering the end of the brush head, however, allows toilet bowl water dripping from the brush head to drip down the enclosure side walls and run out onto surfaces outside the toilet bowl.

There are other tool head cover designs for hand tools which are not specific to toilet hand tools and do not specifically address the issue of contaminated toilet bowl water drippage from toilet hands tools. There are several toothbrush head cover designs in the prior art which cover the brush head but lack a retracting mechanism due to the smaller size of the brush and different intended use of the tool.

A primary objective of this invention is to provide a toilet tool handle with retractable cover which effectively prevents toilet bowl water drippage from a tool head connected to the handle after the tool head has come into contact with toilet bowl water during use.

SUMMARY OF THE INVENTION

A toilet tool handle with retractable tool head cover is provided. An elongate tool handle has an end with a tool head connector thereon. A rack gear extending along the handle's longitudinal axis is positioned adjacent the tool head end. An actuator sleeve, slidable along the handle, has a bearing mounted on it which holds a pinion gear engaged with the rack gear on the handle. The tool head cover is connected to the pinion gear such that sliding action of the actuator sleeve with respect to the handle slides the pinion gear with respect to the rack gear. Engagement of the pinion gear teeth with the rack gear teeth causes the pinion gear to rotate and causes the cover to rotate from a first position where it encloses the tool head end of the handle to a second position where it is rotatably retracted away from the end.

The objects and advantages of the present invention will be more apparent from the following detailed description when taken in conjunction with viewing the accompanying drawings.

BRIEF DESCRIPTION OF THE DRAWINGS

The drawings constitute a part of this specification and include two preferred embodiments of the invention.

DETAILED DESCRIPTION OF A PREFERRED EMBODIMENT

Detailed descriptions of a preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
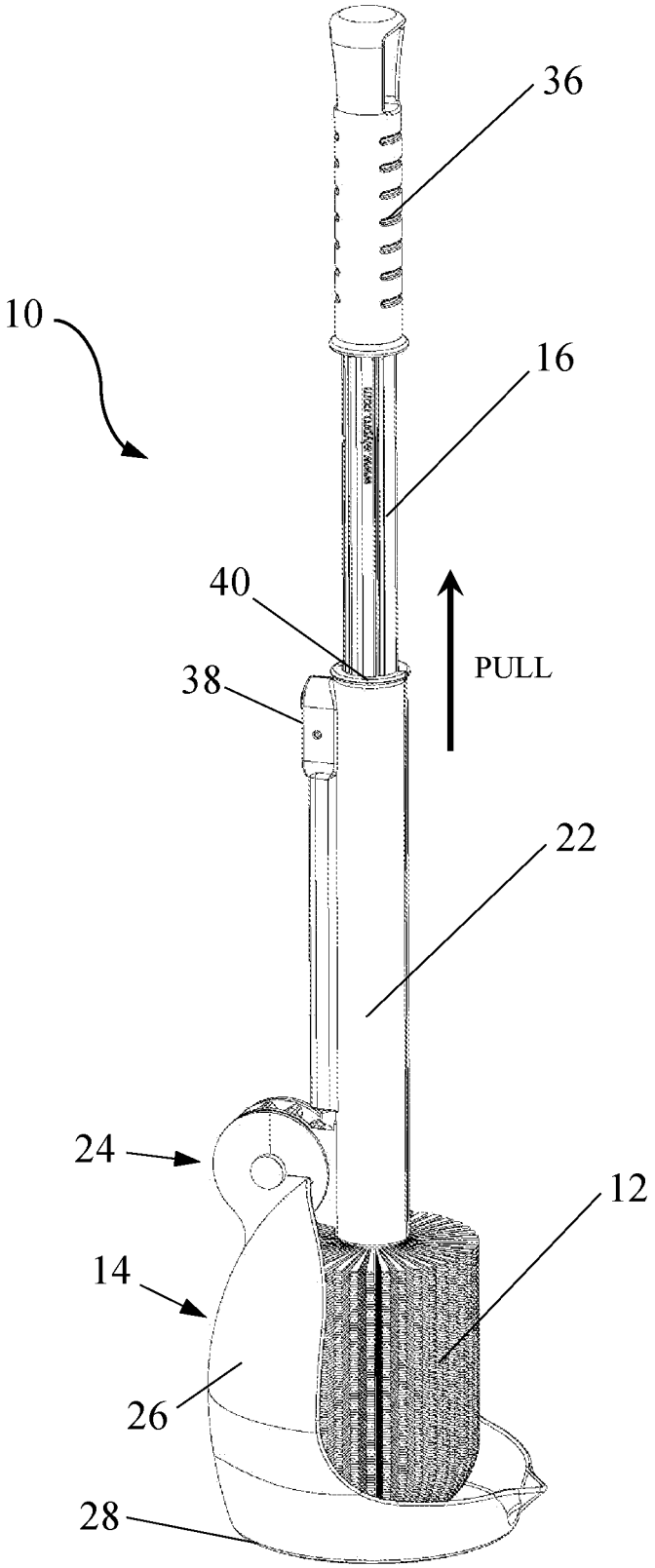
FIG. 1 shows a preferred embodiment of a toilet tool handle with retractable cover according to the invention with a toilet brush tool head connected at its end.
Figure 2:
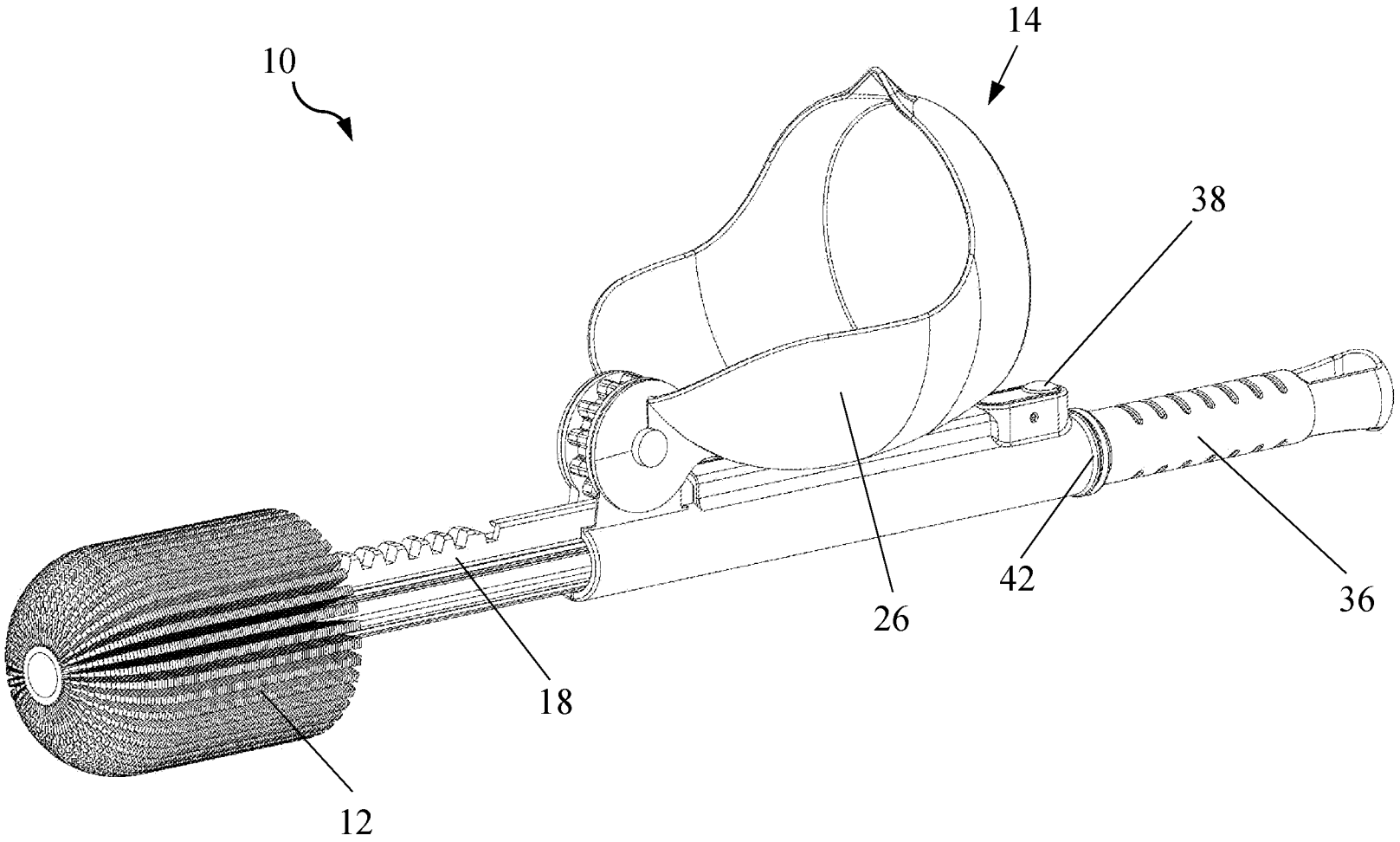
FIG. 2 shows the tool handle of FIG. 1 with its tool head cover fully retracted.

FIGS. 1 and 2 show a preferred embodiment of a toilet tool handle with retractable cover 10 according to the invention with a toilet bowl brush tool head (12) connected thereto for use as a toilet bowl brush. The major components generally comprise (FIG. 1) tool head cover 14, elongate handle 16, rack gear 18 (FIG. 2), tool head connector 20 (FIG. 3), actuator sleeve 22 (FIG. 1), and pinion gear assembly 24. Tool head cover 14 of this preferred embodiment is sized and shaped to enclose brush head 12 when in a fully closed position as shown in FIG. 1 to catch contaminated toilet bowl water dripping from the brush head after the brush has been used to clean a toilet.

The size and shape of tool head cover 14 is generally designed to accommodate the size and shape of the tool head intended to be fastened on to tool head connector 20. FIGS. 1-4 show sidewall 26 of tool head cover 14 with a rounded shape. Other alternative shapes, such as a more flat, conical shape for example, are also contemplated. All of the tool head cover designs include a flat end wall (28) which is used as a base for storing the tool in an upright position when it is not in use, as shown in FIG. 1.

Figure 5:
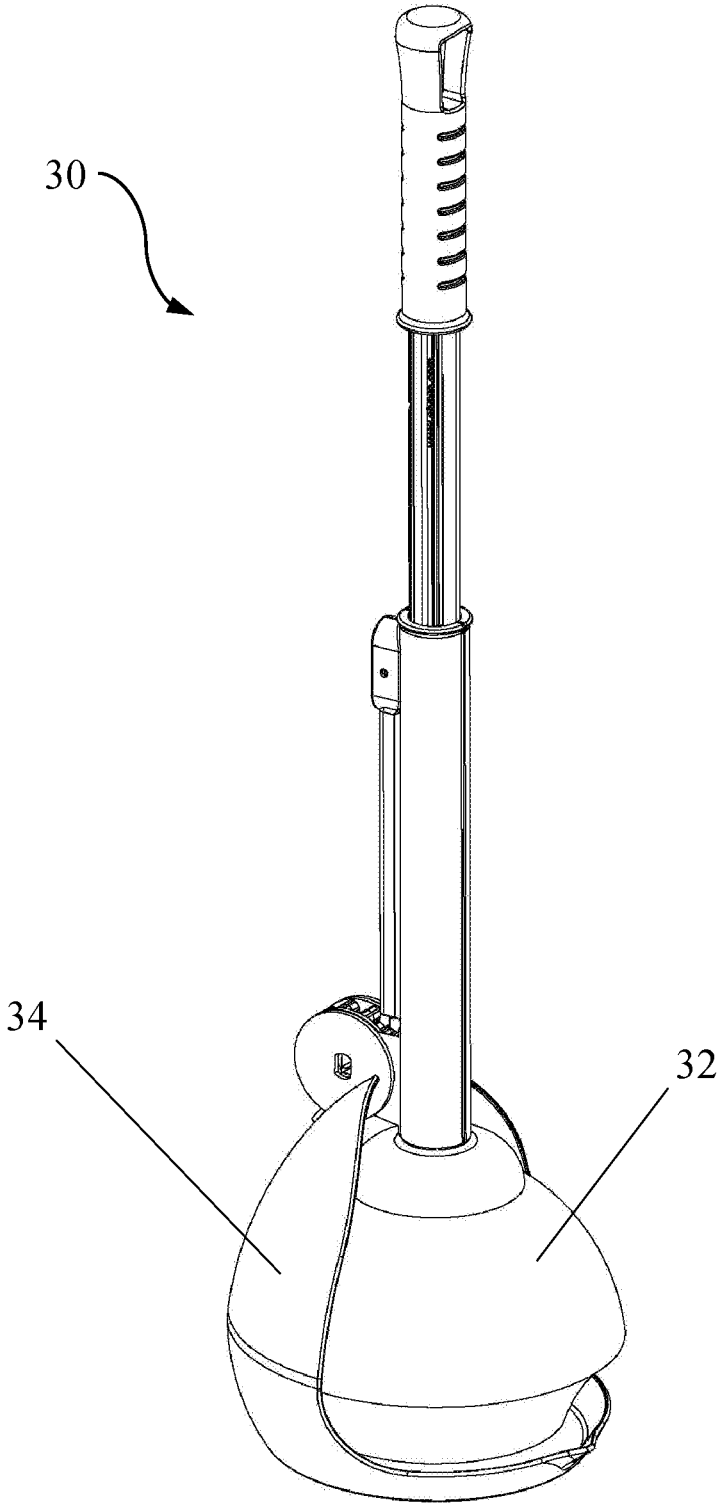
FIG. 5 shows another preferred embodiment of a toilet tool handle with retractable cover according to the invention with a toilet plunger cup tool head connected at its end.
Figure 6:
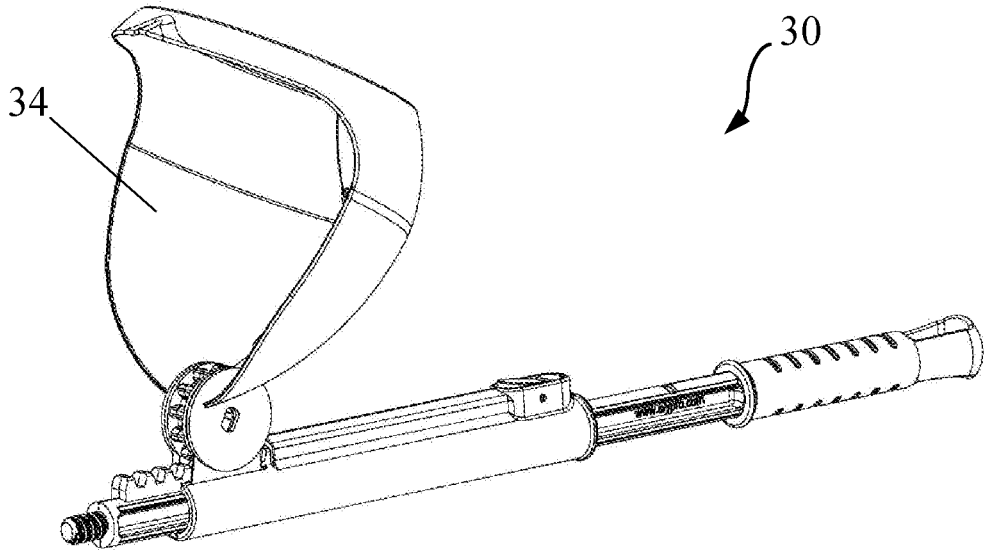
FIG. 6 shows the tool handle of FIG. 5 with its tool head cover partially retracted.
Figure 7:
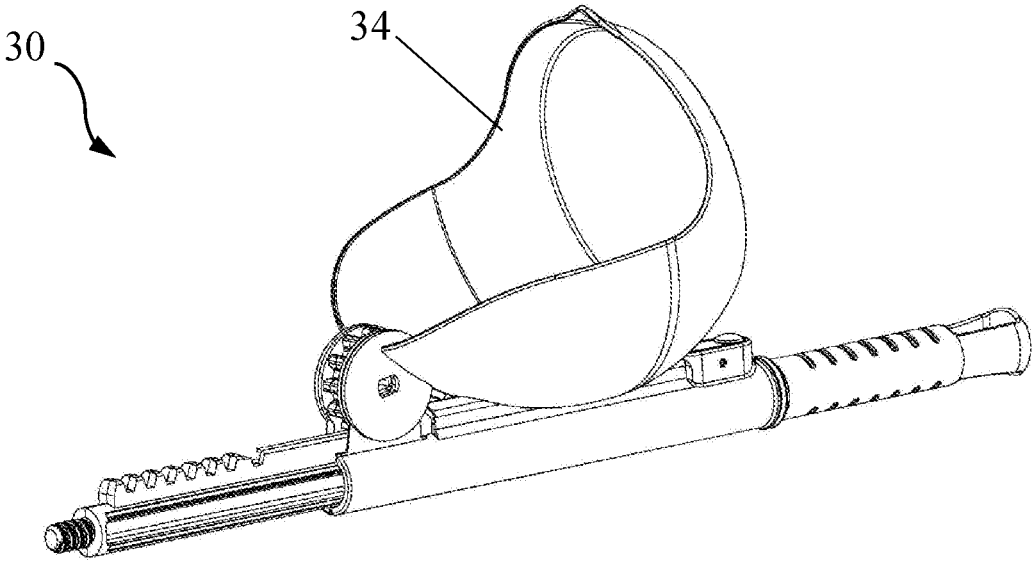
FIG. 7 shows the tool handle of FIG. 5 with its tool head cover fully retracted.

It should be appreciated by one skilled in the art that tool handle 10 can be configured to accept other toilet-related tool heads where the tool head covers are sized and shaped to enclose the particular tool head. For example, FIGS. 5-7 show another preferred embodiment of a toilet tool handle with retractable cover 30 according to the invention with toilet plunger cup 32 connected thereto. Tool head cover 34 is sized and shaped to enclose the plunger cup when in a fully closed position as shown in FIG. 5 so as to catch contaminated toilet bowl water dripping from the plunger cup after it has been used to clear a clogged toilet.

Figure 3:
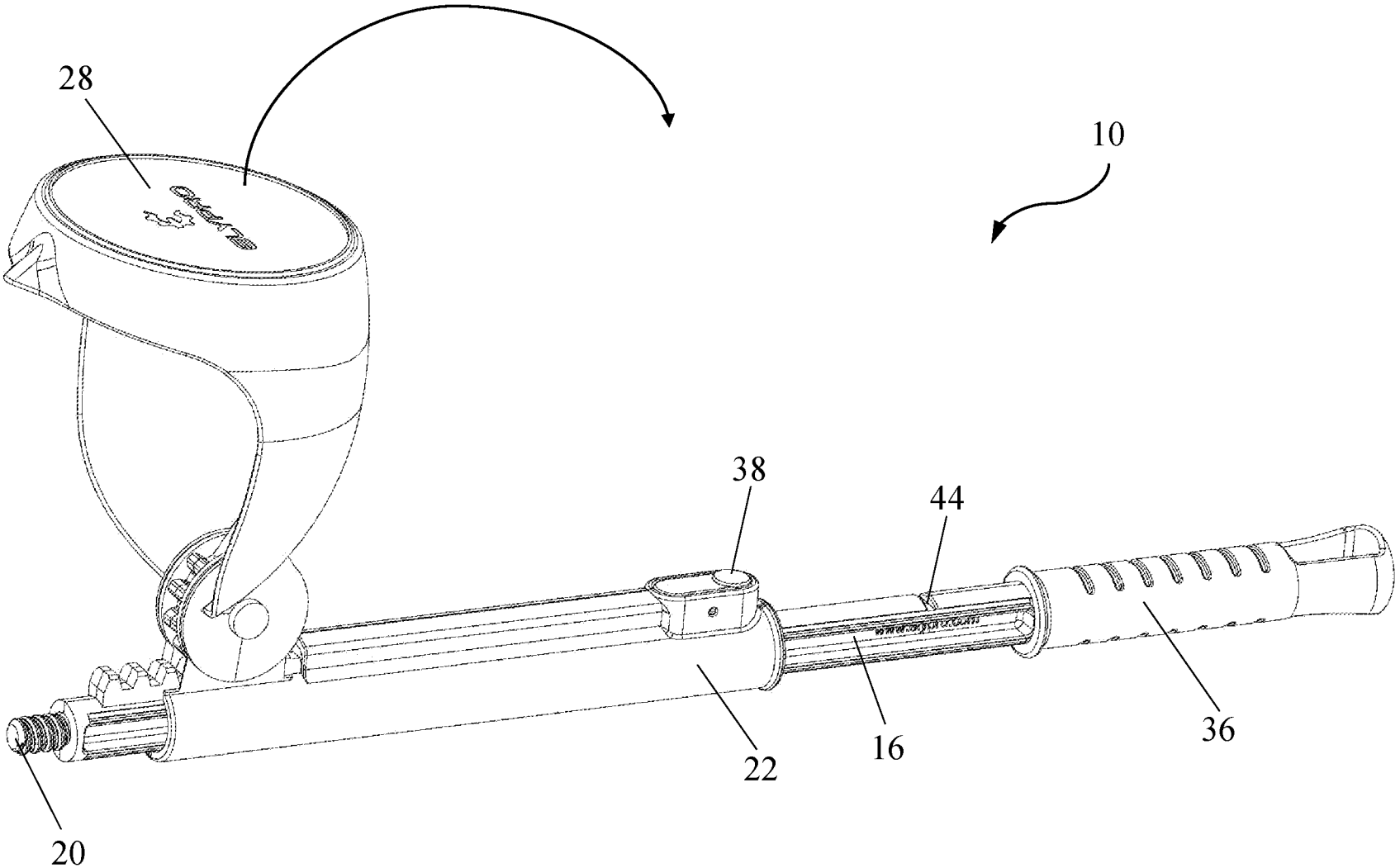
FIG. 3 shows the tool handle of FIG. 1 with its tool head cover partially retracted.
Figure 4:
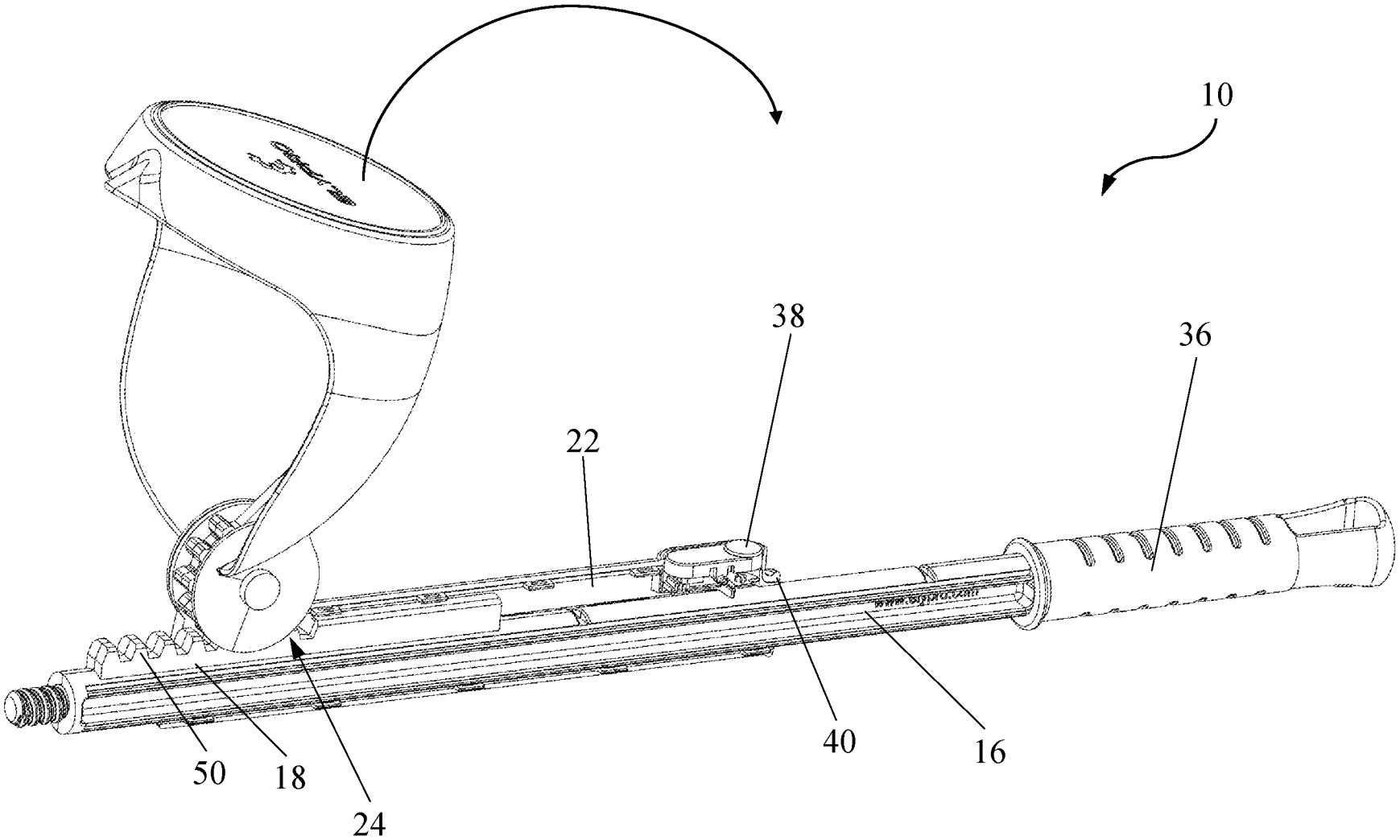
FIG. 4 shows the tool handle of FIG. 1 in partial cross-section.

Toilet tool handle 10 shown in FIGS. 1 through 4 is utilized as a toilet bowl brush by moving tool head cover 14 from a non-use, closed position as shown in FIG. 1 to a fully-retracted, open position as shown in FIG. 2 such that brush head 12 is fully exposed for use as a toilet cleaning tool. The tool head cover (14) is retracted by first grasping hand grip 36 with one hand and grasping actuator sleeve 22 with the other hand with a thumb on the actuator sleeve's spring-loaded release button 38. Release button 38 is then pressed and actuator sleeve 22 is pulled back, axially along elongate handle 16, in the direction of the PULL arrow shown in FIG. 1 such that actuator sleeve 22 is moved from a forward position shown in FIG. 1 to a retracted position shown in FIG. 2. Please notice the change in relative position of actuator sleeve 22 with respect to hand grip 36 where back end 40 of actuator sleeve 22 is moved to abut hand grip 36. Axial movement of actuator sleeve 22 along elongate handle 16 rotates tool head cover 14 as shown in FIGS. 3 and 4, such that tool head cover 14 is retracted and folded away as shown in FIG. 2. Spring-loaded release button 38 is then released to lock actuator sleeve 22 in position with respect to elongate handle 16. The partial cross-sectional view of FIG. 4 shows elongate handle 16 has a forward catch (42) which cooperates with spring-loaded release button 38 to lock the position of actuator sleeve 22 with respect to handle 16 when in a closed position as shown in FIG. 1, and a rear catch (44) which holds actuator sleeve 22 in a retracted position as shown in FIG. 2. The tool head cover is closed by pressing release button 38 to disengage latch arm 46 from catch 44 and pushing actuator sleeve 22 toward the tool head. This rotates the tool head cover in the opposite direction where it can enclose the connected tool head.

Figure 8:
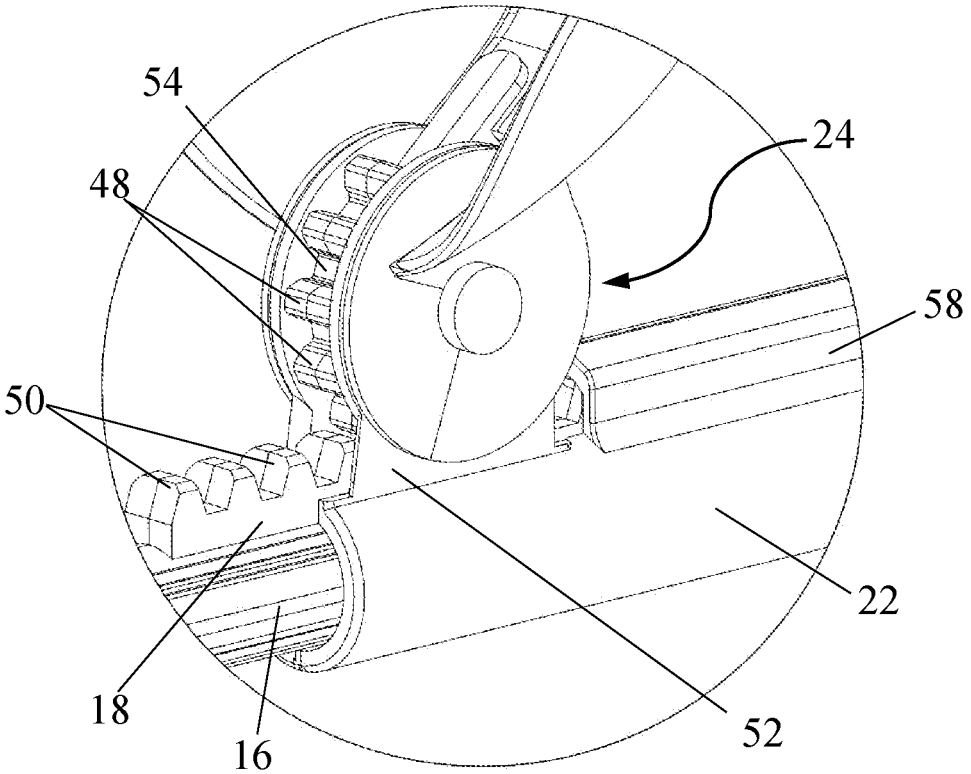
FIG. 8 shows detail of the retractor mechanism.

FIGS. 4 and 8 show detail of the tool head cover retracting mechanism, made up generally of rack gear 18, actuator sleeve 22 and pinion gear assembly 24. It can be appreciated by one skilled in the art that pinion gear teeth 48 engage with rack gear teeth 50 such that sliding motion of actuator sleeve 22 with respect to elongate handle 16 causes pinion gear 54 to rotate within bearing mount 52 on sleeve 22. Rotation of pinion gear 54 correspondingly rotates cover 14 which is connected to pinion gear 54. Rack gear 18 includes spline portion 56 which co-acts with keyway 58 of sleeve 22 to guide sliding action of sleeve 22 with respect to elongate handle 16.

While the invention has been illustrated and described in detail in the drawings and foregoing description, the same is to be considered as illustrative and not restrictive in character, it being understood that only one preferred embodiment has been shown and/or described and that all changes and modifications that come within the spirit of the invention are desired to be protected.

What is claimed is:

1. A tool handle with retractable tool head cover, comprising: an elongate tool handle having a tool head end; a tool head connector on said tool head end; a rack gear adjacent said tool head end, extending along said handle's longitudinal axis; a sleeve engaged with said tool handle to slide longitudinally thereon; a bearing mount on said sleeve; a bearing within said bearing mount; a pinion gear rotatably mounted within said bearing and engaged with said rack gear; and a tool head cover including a cover connection connected to said pinion gear such that sliding action of said sleeve with respect to said handle slides said pinion gear with respect to said rack gear, engaging said pinion gear with said rack gear to cause said pinion gear to rotate within said bearing and cause said cover to rotate from a first position where said cover encloses sad tool head end to a second position where said cover is rotatably retracted away from said tool head end.

2. The tool handle with retractable tool head cover of claim 1, wherein:

said tool head cover comprises an end wall with a substantially flat base area therein, said base area oriented perpendicular to said handle's longitudinal axis when said cover is in said first position.

3. The tool handle with retractable tool head cover of claim 2, wherein:

said tool head cover further comprises a side wall between said cover connection and said end wall, said side wall sized and shaped to accommodate a toilet bowl brush tool head connected to said tool head connector.

4. The tool handle with retractable tool head cover of claim 2, wherein:

said tool head cover further comprises a side wall between said cover connection and said end wall, said side wall sized and shaped to accommodate a toilet bowl plunger tool head connected to said tool head connector.

5. The tool handle with retractable tool head cover of claim 1, further comprising:

a track oriented along said handle's longitudinal axis; and a track follower on said sleeve, said track follower engaged with said track restricting said sleeve to sliding motion along said handle's longitudinal axis.

6. The tool handle with retractable tool head cover of claim 5, wherein:

said tool head cover comprises an end wall with a substantially flat base area therein, said base area oriented perpendicular to said handle's longitudinal axis when said cover is in said first position.

* * * * *